US005335212A

United States Patent [19]

Bartos

[11] Patent Number: 5,335,212

[45] Date of Patent: Aug. 2, 1994

[54] GOLF CLOCK

[76] Inventor: Peter J. Bartos, 2753 Bridle Path Pl., Bethlehem, Pa. 18017

[21] Appl. No.: 639

[22] Filed: Jan. 5, 1993

[51] Int. Cl.[5] ..... G04B 47/00

[52] U.S. Cl. ..... 368/107; 368/10

[58] Field of Search ..... 368/10, 107–113, 368/223–228; 273/32 H, 183 R

[56] References Cited

U.S. PATENT DOCUMENTS

| | | | |
|---|---|---|---|
| 4,062,180 | 12/1977 | Meshi | 58/145 D |
| 4,139,764 | 2/1979 | Petrini et al. | 235/92 |
| 4,293,845 | 10/1981 | Villa-Real | 368/107 |
| 4,303,243 | 12/1981 | Wolfe | 273/176 |
| 4,949,320 | 8/1990 | Karenberg . | |
| 4,962,491 | 10/1990 | Schaeffer | 368/21 |
| 5,008,839 | 4/1991 | Goodwin et al. | 364/200 |
| 5,044,634 | 9/1991 | Dudley | 273/32 |
| 5,086,390 | 2/1992 | Matthews | 364/410 |
| 5,097,416 | 3/1992 | Matthews | 364/410 |
| 5,216,641 | 6/1993 | Hoel | 368/107 |

*Primary Examiner*—Bernard Roskoski
*Attorney, Agent, or Firm*—Eckert Seamans Cherin & Mellott

[57] ABSTRACT

Disclosed is a golf clock and a control system using such clock to control the timing of play of golfers on a golf course. The golf clock has a first digital display programmed to indicate a total elapsed time from the beginning of play to the end of play and a second digital display coupled to a digital memory means capable of receiving, storing and displaying a series of predetermined playing time periods for each hole of the golf course. The golf clock is self contained and is detachably mounted on a golf cart.

5 Claims, 3 Drawing Sheets

GOLF CLOCK

BACKGROUND OF THE INVENTION

This invention relates to a clock system for managing golf courses. It relates particularly to a clock for monitoring the play of a golfer during a round of golf at a golf course.

In many areas, golf has increased in popularity to such an extent that many golf courses are becoming crowded, especially on weekends. When such crowded conditions exist, it is important that the golfers play at reasonable speeds to allow others to also enjoy the golf course. Slow play by some golfers has become a significant problem at many courses with the result that a few slow golfers can delay the play of a large number of subsequent players.

Slow play by a few golfers can greatly reduce the number of golfers able to use a golf course in a day, thereby resulting in a significant loss of revenue to the operator of the golf course. In addition, many golfers will hesitate to play at a golf course where slow play is known to be a problem.

Golf course operators have attempted to eliminate slow play by a number of different approaches. A golf course employee will sometimes be stationed at various positions along the golf course to observe the players, and when slow play is detected to attempt to have the players speed up their play. This approach is not only expensive, but also requires considerable tact on the part of the employee to accelerate the play. Attempts to educate the players regarding the problems of slow play have not been successful, since most golfers do not consider themselves guilty of slow play.

U.S. Pat. No. 5,086,390, issued Feb. 4, 1992 to Matthews, discloses a system for monitoring the speed of play of golfers by using a series of location information transmitters spaced at predetermined locations along the golf course and a mobile electronic transmitter and receiver carried in association with each golfer in a golf bag or golf cart. The system described in the Matthews patent uses a series of signals transmitted from the location information transmitters and the mobile transmitters to a home base receiver to monitor the speed of play of each golfer or golfing group. Such a system is not only very expensive to install and operate, but requires a golf course employee to constantly monitor the signals received and inform errant players about their slow play. Such a system is also subject to very high maintenance costs and vandalism or theft of the transmitters as well as requiring a license to operate from the Federal Communications Commission.

SUMMARY OF THE INVENTION

It is therefore an object of this invention to provide a clock system for managing golf courses that will significantly speed up play on the golf course.

It is another object of this invention to provide a clock system for golfers that is easy to operate and provides a reasonable speed of play discipline for the golfer.

It is a still further object of this invention to provide a clock system for managing golf courses that is relatively inexpensive, easily maintained and adaptable for use with a golf cart.

Other and further objects of this invention will become apparent from the following description and the accompanying drawings and claims.

It has been discovered that the foregoing objects can be attained by a golf clock having a first and a second digital display. The first digital display is programmed to indicate a total lapsed time from the beginning of play to the present. The second digital display is coupled to a digital memory means capable of receiving, storing and displaying a series of predetermined playing time periods for each hole of the golf course.

DESCRIPTION OF THE PREFERRED EMBODIMENT

Figure 1:
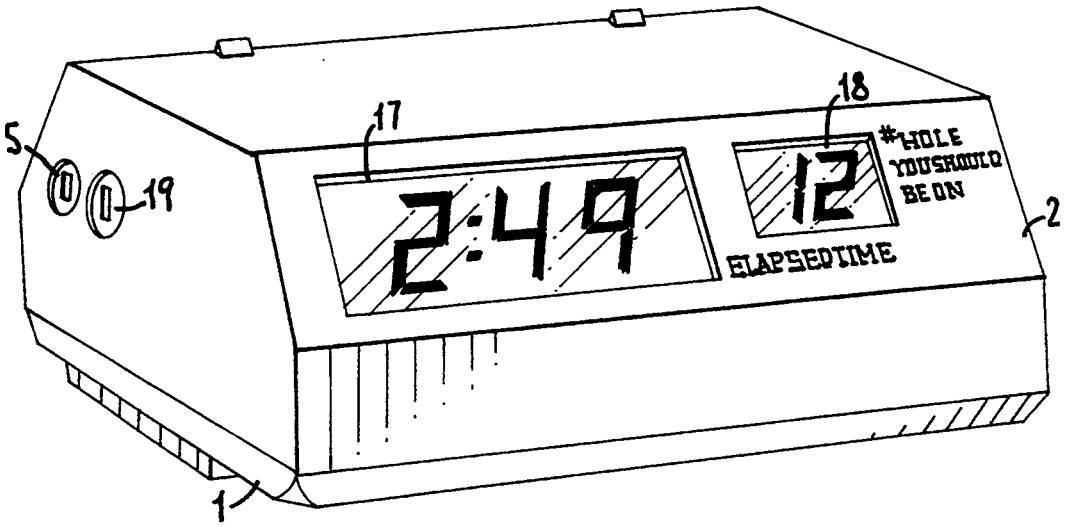
FIG. 1 is an isometric view of the front of one embodiment of the golf clock of this invention.
Figure 2:
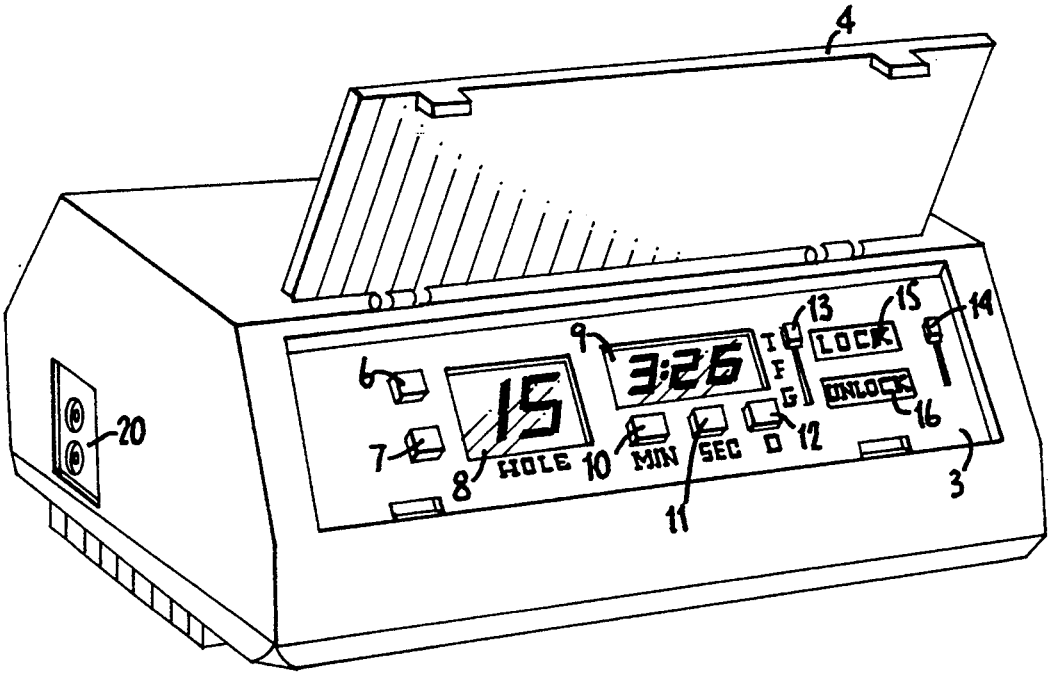
FIG. 2 is an isometric view of the back of the same embodiment of the golf clock of this invention shown in FIG. 1.

FIGS. 1 and 2 illustrate a preferred embodiment of the golf clock of this invention. In this embodiment, the golf clock components are housed in a plastic or metal weather-resistant housing 1 approximately 8 inches long, 4 inches wide and 4 inches deep and suitable for mounting on the dash of a golf cart with a removable, but tamper-resistant mounting to allow the golf clock to be removed for recharging of its battery or for maintenance.

FIG. 1 illustrates the display panel 2 on the front of the golf clock housing 1. FIG. 2 illustrates the control panel 3 on the rear of the golf clock housing 1, which is sealed and protected by a lockable rear cover 4, operable only by an employee of the golf course, through the use of a keyed lock 5 on the side or top of the housing 1. The golfers will not have access to the rear control panel 3.

As shown in FIG. 2, the rear control panel 3 on the rear of the golf clock housing 1, comprises a pair of hole setting switches 6 and 7 associated with a LCD or LED hole display 8. The hole setting switch 6 (UP) will increase the hole number shown on the hole display 8, by one and the hole setting switch 7 (DOWN) will decrease the hole number shown on the hole display 8, by one. The digital hole display 8 will display the number of the hole from one to eighteen that is being programmed.

The rear control panel 3 on the rear of golf clock housing 1 also has a LCD or LED time display 9 designed to display a time interval in minutes and seconds up to ten minutes. Located beneath the time display 9, are three time interval programming switches, 10, 11, and 12. Switch 10 is used to set the number of minutes and switch 11 the number of seconds in the time interval that is programmed by the golf course employee and displayed on the time interval display 9. Switch 12 allows the time interval display 9 to be cleared back to zero.

The rear control panel 3 also has a three position manually settable switch 13 having a (T) position to indicate the area of the golf tee, an (F) position to indicate the area of the golf fairway, and a (G) position to indicate the area of the golf green.

Also located on the rear control panel 3 is a manual lock and unlock switch 14 having position indicia 15 and 16 to indicate if the switch 14 is in a locked or unlocked position. Switch 14 is used to lock into the memory unit contained inside the housing 1, a programmed time interval setting for each hole, as will be explained in further detail below.

As shown on FIG. 1, the front display panel 2 has a total elapsed game time LCD or LED display 17 and a LCD or LED display 18 to indicate the number of the hole and area (tee, fairway or green) of the hole that preferably is being played at the total elapsed time indicated on the total elapsed game time digital display 17, on the front display panel 2.

The elapsed game time display 17 is turned on and activated by a keyed switch 19 at the time of start of play by the golf course starter at the first tee position on the golf course. This elapsed time digital display 17 is connected to a built-in clock unit in the housing 1 and will display the total elapsed playing time (up to 9 hours and 59 minutes) when activated by the keyed switch 19. If desired, the total elapesed time display 17 can be programmed to flash an "F" or other signal to indicate to the golfer that the total elapsed time allotted for completion of the course has expired. The other digital display 18 on the front display panel 2, will show the golfer's desired position on the golf course. This display 18 is operated automatically from a memory unit in the golf clock housing 1 that is programmed from the rear control panel 3 by the golf course employee. The employee is able to allow as much or as little time to each hole and hole area as may seem appropriate for a reasonable playing pace, as well as a refreshment or rest stop, for example at the end of nine holes of play. This programming is done in advance of play by the golf course employee and preferably is made uniform for all the golf clocks in use on that day.

The programming is accomplished by holding down either hole position switch 6 or 7 until the hole display 8 on the rear control panel 3 shows a numeral "1". The employee then moves the three position switch 13 to the "T" position and, using the minute and second switches 10 and 11, enters the time (up to 9 minutes and 59 seconds) allotted as a reasonable time to being on the tee area of Hole No. 1. The employee then enters and locks in the selected allotted time into the memory unit by moving the lock switch 14 until the lock indicia 15 indicates the allotted time has been entered into the memory unit, at which time the employee then moves the lock switch 14 to the unlocked position and moves the three position switch 13 to the (F) position, and then again using the minute and second switches 10 and 11 enters the selected allotted time for being on the fairway area of Hole No. 1. This selected allotted time for the fairway of Hole No. 1 is then entered into the memory unit using the lock switch 14. The three position switch 13 is then moved to the (G) position and a selected allotted time for play on the green area of Hole No. 1 is entered by using the minute and second switches 10 and 11 and then locked into the memory unit by lock switch 14.

This programming procedure is repeated by the course employee for each of the nine or eighteen holes on the course and then the back panel cover 4 is closed and locked with the keyed lock 5. The memory unit module in the golf clock of this invention is programmed in this manner to allow for a reasonable allotted time of play for the tee, fairway and green of each hole. The program can be reset easily by the golf course employee to accommodate the number of golfers using the course on any given day. It is also within the scope of this invention that the allotted time intervals for the entire course may be embodied on a magnetic disc or chip readable by the memory unit and thereby enabling the memory unit to be programmed for the entire course in a single operation.

Once the golf clock memory of this invention has been programmed as described above, and turned on by the keyed switch 19 at the start of play, the digital elapsed time display 17, and the digital hole display 8 on the front display panel 2 will be automatically activated and advanced in accordance with the programmed allotted time stored in the memory unit and by operation of the total elapsed time clock in the unit. As shown in FIG. 2, the digital elapsed time display shows "2:49" indicating a total elapsed playing time of two hours and fourty nine minutes and the digital hole display 8 shows "12G" indicating the golfer for this elapsed playing time, should be playing on the green of the twelfth hole if the golfer is playing a reasonable speed of play. The golf clock of this invention may be powered by a self-contained battery rechargeable through the jacks 20 on the side of the housing 1 or from the golf cart battery.

Figure 3:
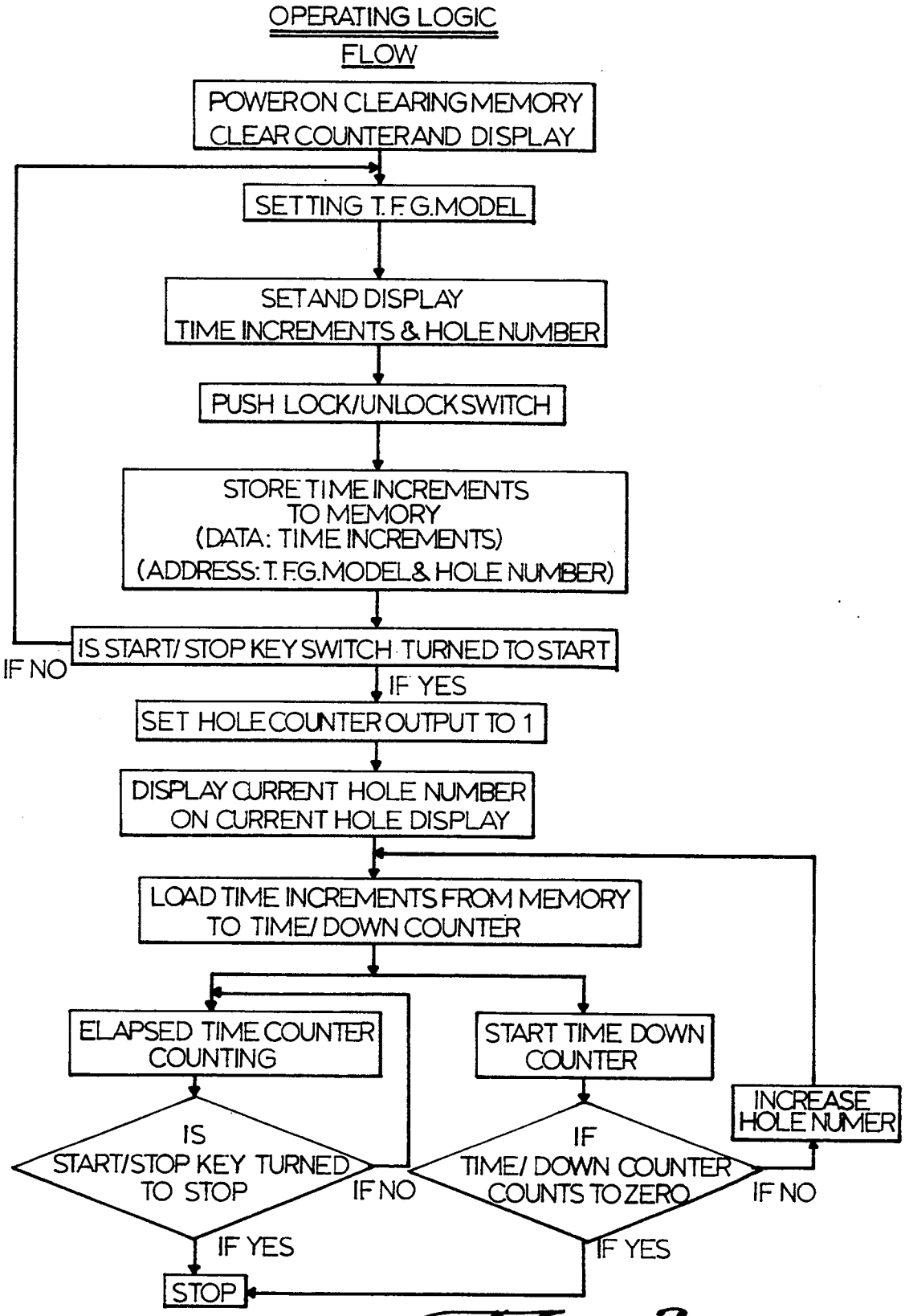
FIG. 3 is a flow chart of the logic used in a preferred embodiment of the golf clock of this invention.

Illustrated in FIG. 3 is a flow diagram of the logic used in operating the golf clock of this invention and described above.

Figure 4:
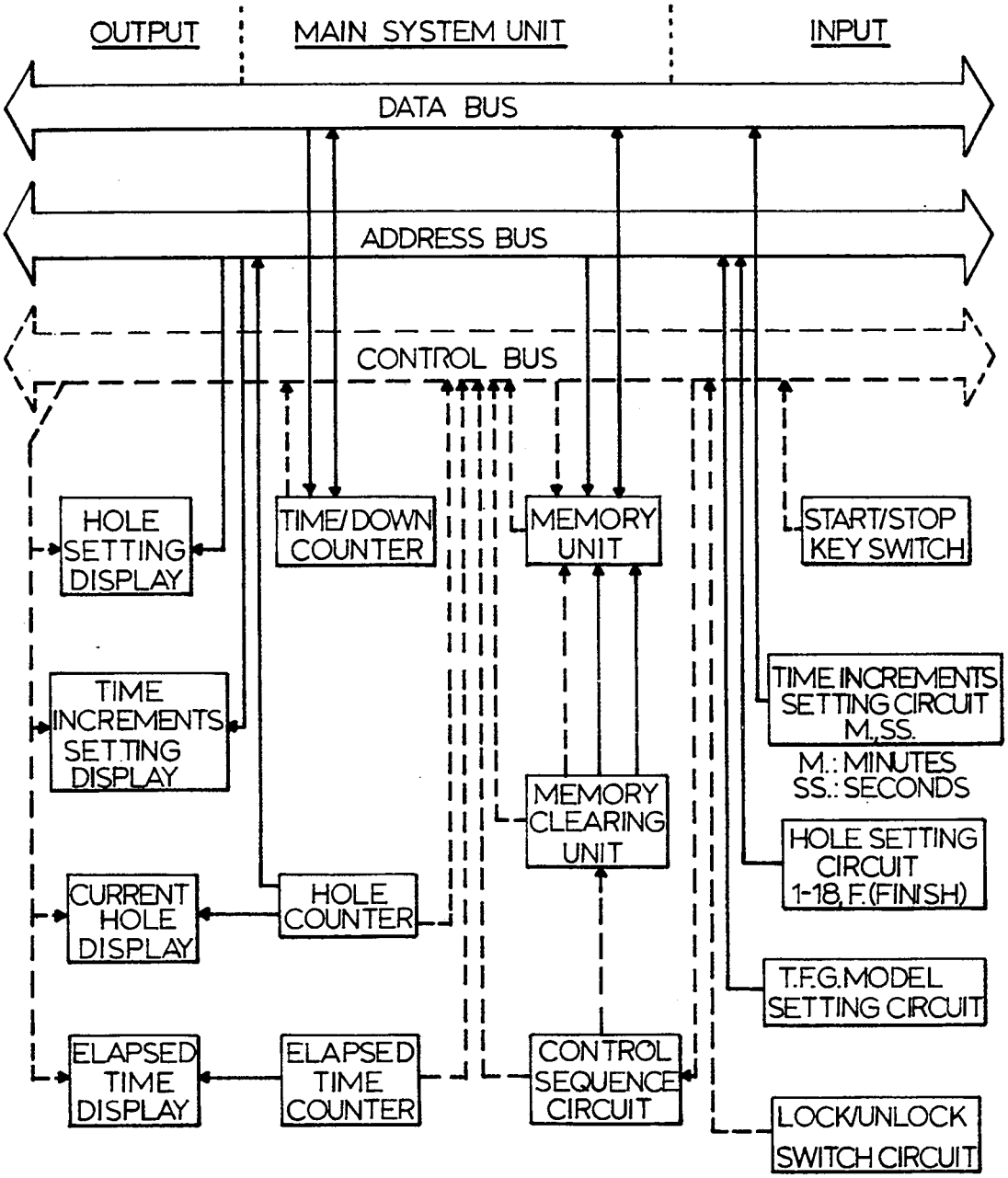
FIG. 4 is a block diagram of the circuitry used in a preferred embodiment of the golf clock of this invention.

FIG. 4 illustrates a block diagram of the circuitry used in a preferred embodiment of this invention and further described below.

The golf clock is powered and controlled by a 12 volt power source that will power the data bus, the address bus and the control bus shown on FIG. 4. The keyed switch 5 circuit starts and stops the elapsed time counter and the controls by turning a key. The time increments circuit incorporates the three time setting switches 10,11 and 12 to program the minutes, seconds or to clear the time increment setting. The hole setting circuit incorporates switches 6 and 7 to provide a hole setting of 1 to 18. The three position switch 13 with the T, F and G settings is in the circuit to describe the area of the hole being programmed. The lock and unlock circuit incorporating switch 14 is used to send the programmed setting for the hole to the memory unit.

The memory unit itself is a simple unit of a size 256 word x 1 bite and stores the time interval programmed for each area of each hole. The memory clearing circuit is used to clear the memory unit content to zero, prior to a new set of programmed instructions. The control unit is a unit for generating the control sequence for the various functions being performed. The time/down counter is used to count down each programmed interval of time that has been programmed into the memory unit. The hole counter is used to count the holes in sequence from 1 to 18. The elapsed time counter displays the total time from the start of play. The hole setting display 8 displays the number of the hole being programmed. The time increments display 9 displays the time interval of each area of the hole being programmed. The elapsed time display 17 displays the current elapsed time since the start of play and the current hole display 18 displays the hole and area of the hole (T, F and G) currently being played.

While I have described this invention by illustrating and describing a preferred embodiment of it, I have done so by way of example, and am not to be limited thereby as there are adaptions and modifications that could be made within the teachings of this invention.

I claim:

1. A golfing clock for controlling the speed of play on a golf course having a housing with a front display panel and rear memory control panel, said front display panel having a first and second digital readout display, said first digital readout display indicating a total lapsed time from the beginning of play on the golf course, said second digital readout display coupled to a programmable memory means within said housing, said second digital readout display displaying the recommended area of play and the hole number for each hole on the golf course programmed to correspond to the total lapsed time displayed by said first digital readout display, the second digital readout displays indicia indicating the tee, fairway, and green areas and the hole number of each hole on the golf course, and in which said memory means can only be programmed by switches on said memory control panel accessible only with a key.

2. The golfing clock of claim 1 in which one or more of said digital readout displays are liquid crystal displays (LCD).

3. The golfing clock of claim 1 in which one or more of said digital readout displays are LED displays.

4. The golfing clock of claim 1 in which said clock is provided with means to detachably secure said clock to a golf cart.

5. The golfing clock of claim 1 in which said clock is powered by a rechargeable battery.

* * * * *